US011296392B1

(12) United States Patent
Huber

(10) Patent No.: US 11,296,392 B1
(45) Date of Patent: Apr. 5, 2022

(54) MAGNETIC STRUCTURE FOR AN ELECTROMAGNETIC RESONATOR, ELECTROMAGNETIC RESONATOR, OSCILLATOR AND METHOD FOR MANUFACTURING A MAGNETIC STRUCTURE

(71) Applicant: Rohde & Schwarz GmbH & Co. KG, Munich (DE)

(72) Inventor: Florian Huber, Munich (DE)

(73) Assignee: ROHDE & SCHWARZ GMBH & CO. KG, Munich (DE)

( * ) Notice: Subject to any disclaimer, the term of this patent is extended or adjusted under 35 U.S.C. 154(b) by 0 days.

(21) Appl. No.: 17/023,580

(22) Filed: Sep. 17, 2020

(51) Int. Cl.

| | |
|---|---|
| ***H01P 1/202*** | (2006.01) |
| ***H01F 7/02*** | (2006.01) |
| ***H01P 1/218*** | (2006.01) |
| ***H01P 1/201*** | (2006.01) |
| ***H01P 7/00*** | (2006.01) |

(52) U.S. Cl.
CPC ..... *H01P 1/201* (2013.01); *H01F 7/021* (2013.01); *H01P 7/005* (2013.01)

(58) Field of Classification Search
CPC ..... H01P 1/202; H01P 1/201; H01P 1/218; H01P 7/06; H01P 7/021; H01F 7/021
See application file for complete search history.

(56) References Cited

U.S. PATENT DOCUMENTS

| | | | | |
|---|---|---|---|---|
| 4,859,975 | A * | 8/1989 | Uetsuhara | H01F 7/08 335/230 |
| 5,677,652 | A | 10/1997 | Parrott | |
| 5,793,268 | A | 8/1998 | Ataiiyan et al. | |
| 6,727,775 | B2 * | 4/2004 | Basawapatna et al. | H04B 1/16 333/17.1 |
| 2005/0230649 | A1 * | 10/2005 | Scheibe | H01F 7/1646 251/129.16 |
| 2005/0275479 | A1 | 12/2005 | Sutton | |

* cited by examiner

*Primary Examiner* — Dean O Takaoka
(74) *Attorney, Agent, or Firm* — Westman, Champlin & Koehler, P.A.

(57) ABSTRACT

A magnetic structure for an electromagnetic resonator is provided. The magnetic structure comprises at least a solenoid and a permanent magnet, wherein the solenoid and the permanent magnet are concentrically arranged to each other such that the magnetic field lines provided by the permanent magnet are at least essentially perpendicular to magnetic field lines of a magnetic field generated by the solenoid. The arrangement of the permanent magnet and the solenoid may be housed by an element with a high magnetic permeability.

20 Claims, 3 Drawing Sheets

MAGNETIC STRUCTURE FOR AN ELECTROMAGNETIC RESONATOR, ELECTROMAGNETIC RESONATOR, OSCILLATOR AND METHOD FOR MANUFACTURING A MAGNETIC STRUCTURE

TECHNICAL FIELD

The present invention relates to a magnetic structure for an electromagnetic resonator. The present invention further relates to an electromagnetic resonator and an oscillator comprising such a magnetic structure. Further, the present invention relates to a method for manufacturing a magnetic structure for an electromagnetic resonator.

BACKGROUND

Even though applicable in general to electromagnetic resonators for any kind of devices, in particular signal generators or filter devices, the present invention and its underlying problem will be hereinafter described in connection with a signal generating device generating high frequency signals.

Modern signal generators or measurement devices such as a spectrum analyzer or the like have very high demands of the quality of high frequency reference signals. In particular, such devices require signals with very low phase noise. For example, an yttrium iron garnet (YIG) oscillator may be used as a reference source. YIG oscillators require a strong magnetic field for generating a high frequency ferromagnetic resonance which can be used for generating high frequency signals. Such strong magnetic fields may be generated by an electromagnet such as a solenoid or the like. Furthermore, it may be possible to use a permanent magnet in combination with an electromagnet.

SUMMARY

Against this background, there is a need for an improved magnetic structure of an electromagnetic resonator.

The present invention provides a magnetic structure for an electromagnetic resonator, an electromagnetic resonator, an oscillator and a method for manufacturing a magnetic structure for an electromagnetic resonator with the features of the independent claims. Further advantageous embodiments are subject matter of the dependent claims.

According to a first aspect, a magnetic structure for an electromagnetic resonator is provided. The magnetic structure comprises a housing element, a solenoid and a first permanent magnet. The housing may have a high magnetic permeability. The solenoid and the first permanent magnet are housed in the housing element. The solenoid and the first permanent magnet are further arranged concentrically to each other with respect to a predetermined axis. The magnetic field lines of the first permanent magnet are essentially perpendicular to the magnetic field lines of a magnetic field generated by the solenoid. In particular, the magnetic field lines of the first permanent magnet and the magnetic field lines generated by the solenoid are essentially perpendicular to each other at least in an inner area of the concentrically arranged solenoid and first permanent magnet.

According to a second aspect, an electromagnetic resonator is provided. The electromagnetic resonator comprises a magnetic structure according to the first aspect.

According to a third aspect, an oscillator is provided. The oscillator comprises a magnetic structure according to the first aspect or an electromagnetic resonator according to the second aspect.

According to a further aspect, a method for manufacturing a magnetic structure for an electromagnetic resonator is provided. The method comprises a step of providing a housing element. The housing element may have a high magnetic permeability. The method further comprises a step of providing a solenoid and a first permanent magnet. Further, the method may comprise arranging the solenoid and the first permanent magnet in the housing element. The solenoid and the first permanent magnet may be arranged in the housing element concentrically to each other with respect to a predetermined axis. The magnetic field lines of the first permanent magnet in the arrangement may be essentially perpendicular to the magnetic field lines of a magnetic field generated by the solenoid. In particular, the magnetic field lines of the first permanent magnet may be at least perpendicular to the magnetic field lines of the solenoid at least in an inner area of the concentrically arranged solenoid and the first permanent magnet.

The present invention is based on the finding that high frequency signals with low phase noise are required for many applications, for example signal generators, measurement devices or the like. For this purpose, YIG oscillators may be used as reference sources for locally generating high quality radio frequency signals. YIG oscillators require an adjustable strong magnetic field. Accordingly, an arrangement for generating the required strong magnetic field may be complex and requires large assembly volume.

The present invention takes into account this finding and aims to provide a magnetic structure for an electromagnetic resonator having improved properties. In particular, the present invention aims to provide a magnetic structure for an electromagnetic resonator requiring reduced assembly volume. Further, the present invention aims to provide a magnetic structure of an electromagnetic resonator which can be used for relative high frequencies. Especially, the present invention aims to provide a magnetic structure for an electromagnetic resonator with an improved sensitivity of the windings of a solenoid used in such a magnetic structure.

The magnetic structure may be realized by a combination of at least one permanent magnet and a solenoid which are arranged concentrically to each other. In general, the solenoid and the permanent magnet may have any kind of appropriate shape, for example a shape of a toroid. A toroid is a surface of revolution with a hole in the middle, forming a solid body. The axis of revolution passes through the hole and so does not intersect the surface of the toroid. For example, the toroid may be a torus having a circular cross section, or a toroid having a square or rectangular cross section.

Alternatively, the permanent magnet and/or the solenoid may have, for instance, any other rotationally symmetric shape. For example, a cross section perpendicular to an axis of symmetry of the permanent magnet and/or the solenoid may have a shape polygon with a hole in the middle. For example, an inner and/or outer circumference of a cross-section perpendicular to the axis of symmetry of the rotationally symmetric element may have a shape of a hexagon or octagon. However, any polygon having another number of edges may be also possible.

The permanent magnet and/or the solenoid may have any kind of rotationally symmetric shape such that the respective element may look the same after a rotation by a partial turn of 180 degrees or less. In such a case, the permanent magnet and the solenoid may be concentrically arranged with respect to the axis of symmetry of the respective rotationally symmetric element.

The permanent method may be realized by a single element. However, it may be also possible that the permanent magnet may be formed my multiple elements having multiple segments or the like. In particular, the multiple elements may have same or at least similar shape.

The solenoid may be any kind of electromagnet having a specific number of windings. Accordingly, a strength of the magnetic field generated by the solenoid may be controlled according to a direction and a current flowing through the windings of the solenoid. For this purpose, any kind of appropriate power source for providing an appropriate current through the solenoid may be possible. Accordingly, the solenoid may generate a magnetic field with field lines being almost parallel to each other in an inner area of the solenoid.

The permanent magnet may be arranged concentrically to the solenoid. In particular, the permanent magnet may provide a homogeneous magnetic field such that the filed lines in the inner area of the solenoid and the concentrically arranged permanent magnet are almost perpendicular to the field lines of the magnetic field generated by the solenoid. For this purpose, the permanent magnet may provide a magnetic field such that the field lines of the magnetic field are almost perpendicular to the surface of the permanent magnet facing in the direction to the solenoid. Preferably, the size and the shape of the permanent magnet and the solenoid are adapted to each other such that the outer surface of the permanent magnet directing towards to the solenoid fits the outer surface of the solenoid facing towards the permanent magnet. In particular, the permanent magnet and the solenoid are arranged such that there is no gap or at least only a very small gap between the permanent magnet and the solenoid.

The permanent magnet may be manufactured by any kind of appropriate material which may be used for manufacturing permanent magnets.

The combination of the solenoid and the permanent magnet may be housed in an appropriate housing element. In particular, the housing element may be a housing element of a material having high magnetic permeability. As will be described in more detail below, the housing element may be manufactured by a material of iron, nickel, cobalt or an alloy thereof. However, any other appropriate material in particular ferromagnetic material may be possible, too.

In order to arrange the solenoid and the permanent magnet in the housing element, the inner space of the housing element may be adapted to the shape of the solenoid and the permanent magnet. For this purpose, the surfaces of the inner space of the housing element may be adapted to the related surfaces of the solenoid and/or the permanent magnet at least partially. However, as will be also described in more detail below, the size of the inner volume of the housing element may be larger than required for accommodating the solenoid and the permanent magnet in order to provide additional space.

Further embodiments of the present invention are subject of the further subclaims and of the following description referring to the drawings.

In a possible embodiment, the solenoid and the first permanent magnet may have a rotationally symmetric shape. For example, the solenoid and/or the first permanent magnet may have a shape of a toroid. However, it may be also possible that the solenoid and/or the first permanent magnet may have a rotationally symmetric shape based on a polygon, for example a hexagon or the like.

The solenoid and/or the first permanent magnet may any kind of appropriate cross section. For example, the cross section of the solenoid and/or the first permanent magnet may be rectangular or square. In particular, a surface of the permanent magnet and a surface of the solenoid facing to each other may be adapted such that respective surfaces fit each other. In this way, a gap between the solenoid and the first permanent magnet may be reduced.

In a possible embodiment, the magnetic structure may have a rotationally symmetric shape. Accordingly, not only the solenoid and a first permanent magnet but also the further elements, in particular the housing element may be rotationally symmetric. For example, an inner space/cavity of the housing element may be adapted to the shape of the solenoid and the permanent magnet at least partially.

In a possible embodiment, the magnetic structure may further comprise free space in an inner area of the housing element accommodating the solenoid and the first permanent magnet. In other words, the volume of the housing element may still provide free space after the solenoid and the first permanent magnet are arranged in this inner volume. Accordingly, this additional free space may accommodate additional elements. In this way, a very compact arrangement is provided requiring only a minimum volume.

In a possible embodiment, the magnetic structure may further comprise an oscillator circuit or a filter circuit. The oscillator circuit or filter circuit may be arranged in the free space of the inner volume of the housing element. Accordingly, an oscillator or a filter device can be realized by a very compact arrangement. For this purpose, the oscillator or filter circuit may comprise any kind of appropriate elements such as resistors, inductors, capacitors or the like.

In a possible embodiment, the magnetic structure may further comprise a center element. The center element may have a high magnetic permeability. For this purpose, the center element may be realized, for example by ferromagnetic material being the same or similar to the material used for the housing element. The center element may be arranged in an inner area of the concentrically arranged solenoid and the first permanent magnet. For example, an outer surface facing to the arrangement of the first permanent magnet and the solenoid may be adapted to a surface of the permanent magnet or the solenoid facing to the center element. In this way, the magnetic field lines may be guided by the center element and the housing element.

In a possible embodiment, the magnetic structure may have a gap between the center element and the housing element. For example, the center element may be coupled directly or via a further element to the housing element on one side facing to the housing element. Further, the above-mentioned gap may be located between the side opposite to the side of the center element coupled to the housing element.

In a possible embodiment, the magnetic structure may comprise a sphere disposed in the gap. In particular, the sphere disposed in the gap may be an yttrium iron garnet (YIG) sphere. The sphere may have a diameter of 1 mm or less. Accordingly, the magnetic structure with such a sphere in the gap between the center element and the housing element may form a YIG resonator.

In a possible embodiment, the magnetic structure may further comprise a second permanent magnet. The second permanent magnet may be arranged between the center element and the housing element. Such a second permanent magnet may prevent a short circuit and force the magnetic field towards the gap between the center element and the housing element.

Accordingly, the magnetic strength in the gap can be further improved.

In a possible embodiment, the gap is located in a position opposite to the second permanent magnet. In this way, the center element is coupled to the housing element via the second permanent magnet. In particular, the second permanent magnet may force the magnetic field towards the gap to increase the magnetic strength in the gap.

In a possible embodiment, a diameter of the second permanent magnet may be larger than a diameter of the center element. In this way, the isolation of the magnetic field can be further improved.

In a possible embodiment, the position of the first permanent magnet is adjustable. In particular, the position of the first permanent magnet is adjustable in a direction parallel to a symmetry axis of the solenoid and/or a symmetry axis of the first permanent magnet. By adapting the position of the first permanent magnet, the magnetic flow can be adapted accordingly.

In a possible embodiment, the first permanent magnet may have a shape of a toroid. Such a permanent magnet having the shape of a toroid may be manufactured easily as a single element.

In an alternative embodiment, the permanent magnet may comprise multiple segment magnets. In particular, the first permanent magnet may comprise multiple segment magnets having a same shape. In this way, the permanent magnet may be assembled by combining multiple segment magnets.

In a possible embodiment, the first permanent magnet may provide a magnetic field with radial oriented magnetic field lines. Accordingly, the field lines may be perpendicular to the surfaces facing towards the center element and the solenoid.

In a possible embodiment, the housing element may be manufactured by a ferromagnetic material. In particular, the housing element may comprise or consist of iron, nickel, cobalt or an alloy thereof.

With the present invention it is therefore possible to provide a magnetic structure for an electromagnetic resonator which can be used in an electromagnetic resonator for generating high quality high frequency signals having low phase noise. In particular, the electromagnetic resonator with such a magnetic structure requires reduced assembly volume. Further, it is possible to achieve higher frequencies with reduced assembly volume and power loss. Such electromagnetic resonators may be used, for example in oscillators or frequency filters. For example, such electromagnetic resonators may be used in signal generating devices, in particular for local oscillators providing high quality reference signals. Furthermore, the signal generators may be also used in measurement devices such as, for example a spectrum analyzer or the like.

BRIEF DESCRIPTION OF THE DRAWINGS

For a more complete understanding of the present invention and advantages thereof, reference is now made to the following description taking in conjunction with the accompanying drawings. The invention is explained in more detail below using exemplary embodiments, which are specified in the schematic figures and the drawings, in which.

Figure 1:
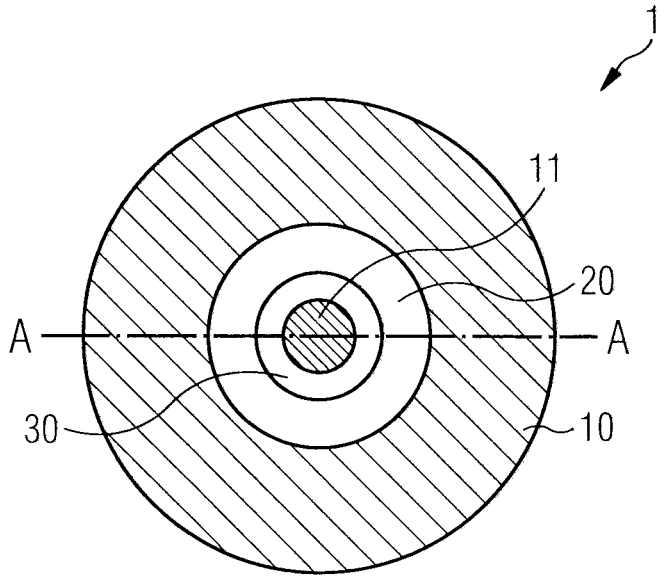
FIG. 1: shows a schematic drawing of a top view of a magnetic structure according to an embodiment.

The appended drawings are intended to provide further understanding of the embodiments of the invention. They illustrate embodiments and, in conjunction with the description, help to explain principles and concepts of the invention. Other embodiments and many of the advantages mentioned become apparent in view of the drawings. The elements in the drawings are not necessarily shown in scale.

In the drawings, same, functionally equivalent and identical operating elements, features and components are provided with same reference signs in each case, unless stated otherwise.

DESCRIPTION OF EMBODIMENTS

FIG. 1 shows a schematic diagram illustrating a top view of a magnetic structure 1 for an electromagnetic resonator. The magnetic structure 1 may comprise at least a housing element 10 with a solenoid 20 and a first permanent magnet 30. In particular, the solenoid 20 and the first permanent magnet 30 may be accommodated in a cavity of the housing element 10.

The solenoid 20 may comprise a coil with a number of one or more windings. Accordingly, solenoid 20 may provide a magnetic field when an electric current is flowing through the windings of the coil. The coil of the solenoid 20 may be connected to an appropriate current source for providing the current in order to generate the magnetic field.

The solenoid 20 may have a rotationally symmetric shape. For example, the solenoid 20 may have a shape of a toroid or the like. However, any other rotationally symmetric shape may be possible, too. For example, the solenoid 20 may have the shape of an arbitrary rotationally symmetric element, for instance, a regular polygon, e.g. a hexagon or octagon, with a hole in the middle.

The first permanent magnet 30 of the magnetic structure 1 also may have a rotationally symmetric shape, for example a toroid or another rotationally symmetric element with a hole in the middle. In particular, the first permanent magnet 30 and the solenoid 20 may be arranged concentrically to each other. Accordingly, a symmetry axis of the rotationally symmetric solenoid and a symmetry axis of the rotationally symmetric first permanent magnet may be the same. Further, an outer surface of the first permanent magnet 30 facing towards the solenoid 20 may be adapted to the outer surface of the solenoid 20 facing towards the first permanent magnet 30. Accordingly, the solenoid 20 and the first permanent magnet 30 may be arranged such that there is no gap between the solenoid 20 and the first permanent magnet 30, or such that the gap between the solenoid 20 and the first permanent magnet 30 is minimized. The first permanent magnet 30 max be arranged in a position between the solenoid 20 and symmetry axis of the solenoid 20.

The first permanent magnet 30 may provide a radial magnetic field. Accordingly, field lines of the magnetic field provided by the first permanent magnet 30 may be almost perpendicular to the surface of the first permanent magnet 30 facing towards the solenoid 20. Even though FIG. 1 shows a magnetic field with a magnetic north pole N facing towards the point of symmetry of the rotationally symmetric first permanent magnet 30 and a magnetic south pole S facing towards the solenoid 20, it may be also possible that the first permanent magnet 30 provides a magnetic field having an opposite direction.

The first permanent magnet 30 may comprise or consist of any appropriate material for manufacturing permanent magnets. For example, the first permanent magnet 30 may be manufactured by a ferromagnetic or ferrimagnetic material. In particular, the first permanent magnet may be manufactured by materials comprising iron, nickel and/or cobalt or an alloy thereof.

The first permanent magnet may be a permanent magnet manufactured as a single piece. Alternatively, it may be also possible that the first permanent magnet 30 may be realized by combining multiple pieces. For example, the first permanent magnet 30 may be realized by multiple segments, in particular multiple identical segments. The multiple segments may be put together in order to form a rotationally symmetrical first permanent magnet 30.

The housing element 10 may have a shape for accommodating the solenoid 20 and the first permanent magnet 30 in a cavity of the housing element 10. Accordingly, housing element 10 may provide a rotationally symmetric cavity for housing the solenoid 20 and the first permanent magnet 30.

As can be seen, for example, in FIG. 1, a center element 11 may be provided in an inner area of the arrangement comprising the solenoid 20 and the first permanent magnet 30. The center element 11 may be a part of the housing element 10.

Alternatively, center element 11 may be a separate part. In case that the center element 11 is a separate part, the center element may be either directly connected to the housing element 10 or a further element, for example a second permanent magnet 40 may be disposed between the center element 11 and the housing element 10. Such a configuration will be described in more detail below.

The housing element 10 and the center element 11 may comprise a material with a high magnetic permeability. In particular, the magnetic permeability may be significantly larger than 1. For example, the housing element 10 and the center element 11 may consist of or at least comprise a ferromagnetic material such as iron, ferrite, cobalt, nickel or an alloy thereof. However, it is understood, that any other appropriate material having a high magnetic permeability may be possible, too.

In order to arrange the solenoid 20 and the first permanent magnet 30 in the housing element 10, the housing element 10 may consist of multiple parts. For example, the housing element 10 may comprise an upper part and a lower part which may be put together in order to form the housing element 10. Accordingly, the solenoid 20 and the first permanent magnet 30 may be put into the cavity of the housing element 10 and subsequently, the individual parts of the housing element 10 may be put together. However, any other manner for combining the solenoid 20 and the first permanent magnet 30 with the housing element 10 may be possible, too.

The solenoid 20 and the first permanent magnet 30 are assembled such that the magnetic field lines of the magnetic field provided by the first permanent magnet 30 are at least almost perpendicular to magnetic field lines of a magnetic field generated by the solenoid 20. Specifically, the magnetic field lines of the magnetic field provided by the first permanent magnet 30 and the magnetic field lines provided by the magnetic field generated by the solenoid 20 are at least almost perpendicular in an inner area of the arrangement of the solenoid 20 and the first permanent magnet 30. As already described above, the center element 11 may be arranged in this inner area. Such an arrangement can be achieved by a first permanent magnet 30 providing radial magnetic field lines in combination with a solenoid having one or more concentric windings with respect to a symmetry axis of the concentrically arranged solenoid 20 and the first permanent magnet 30.

Figure 2:
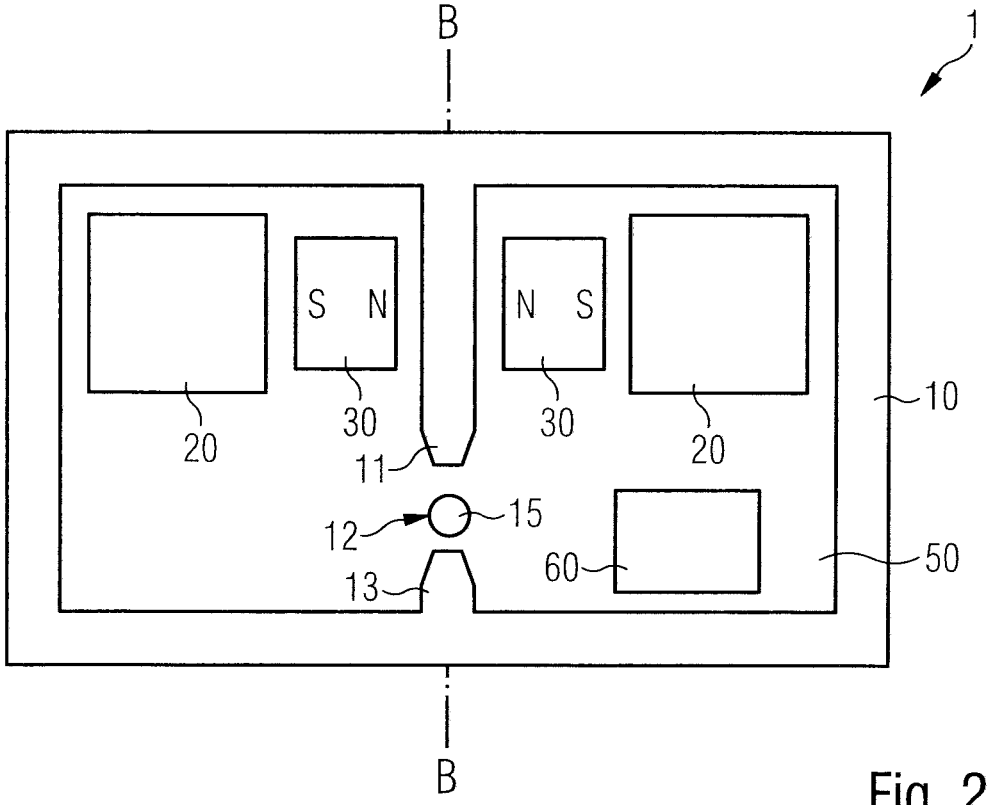
FIG. 2: shows a schematic drawing of a cross section of a magnetic structure according to an embodiment.

FIG. 2 shows a schematic diagram illustrating a cross section through the magnetic structure 1 along a plane A-A in FIG. 1. The magnetic structure 1 in this example comprises a solenoid 20 and a first permanent magnet 30 which are at least rotationally symmetric with respect to a symmetry axis B-B. Housing element 10 comprises an inner cavity accommodating solenoid 20 and the first permanent magnet 30. In this example, center element 11 is directly connected to an upper part of the housing element 10. Further, housing element 10 may comprise a lower tip 13 which is located opposite to center element 11. Consequently, a small gap 12 exists between center element 11 and tip 13. In this way, a YIG resonator may be realized by arranging and YIG sphere 15 in the gap 12 between the center element 11 and the tip 13.

Due to the high magnetic permeability of the housing element 10 with the center element 11 and the tip 13, the magnetic flow provided by the first permanent magnet 30 in combination with the magnetic field generated by the solenoid 20 can be guided through the center element 11, the housing element 10 and the tip 13 and further through the gap 12 with YIG sphere 15.

As can be further seen in FIG. 2, the cavity of housing element 10 for housing the solenoid 20 and the first permanent magnet 30 may be larger than required for accommodating the solenoid 20 and the first permanent magnet 30. Accordingly, a free space area 50 may exist between an inner sidewall of the cavity of the housing element 10 and the arrangement with the solenoid 20 and the first permanent magnet 30. Accordingly, additional elements may be also housed in the cavity of the housing element 10.

For example, an additional circuit element 60 may be located in the free space area 50 of the cavity provided by the housing element 10. For example, the additional circuit may be an oscillator circuit for stimulating the resonator arrangement with the magnetic structure 1. Alternatively, circuit 60 may be comprise a filter circuit for filtering specific frequencies according to a resonance frequency of the electromagnetic resonator with the magnetic structure 1. However, any other kind of circuit or device may be also put in the free space area 50 of the cavity provided by the housing 10. In particular, circuit 60 may provide and/or control a current flowing through the windings of the solenoid 20.

Figure 3:
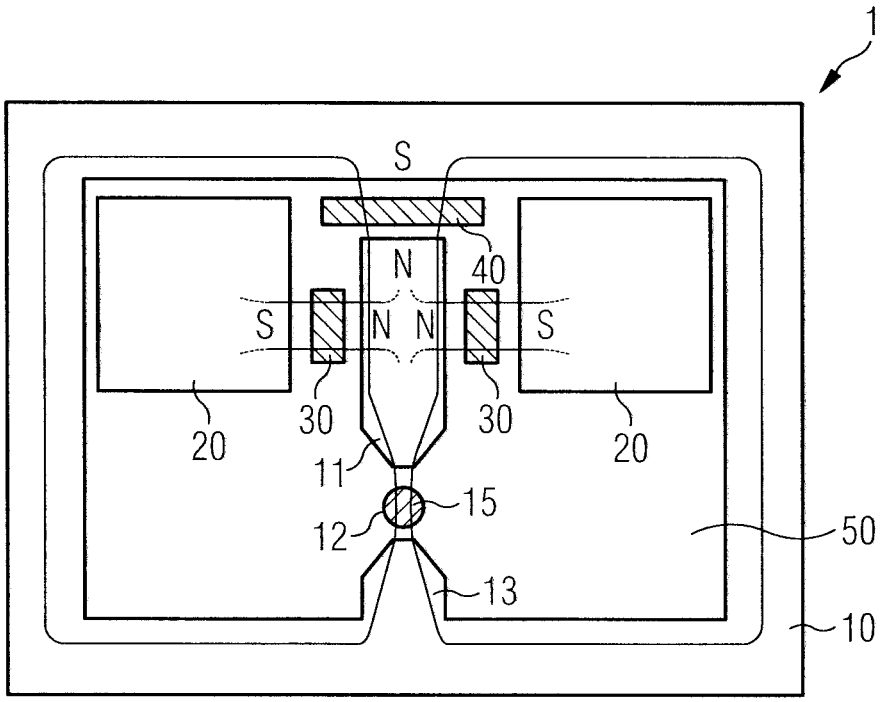
FIG. 3: shows a cross section of a magnetic structure according to an embodiment.

FIG. 3 shows a further example of a cross section through an arrangement for an electromagnetic resonator with a magnetic structure 1 according to an embodiment. The example according to FIG. 3 mainly corresponds to the previously described example. In the example according to FIG. 3, an additional second permanent magnet 40 is arranged between the housing element 10 and the center element 11. For example, the second permanent magnet 40 may have a shape of a circular disc. The second permanent magnet 40 may provide a magnetic field with field lines in axial direction with respect to the symmetry axis B-B of the rotationally symmetrical arrangement with the solenoid 20 and the first permanent magnet 30. In case that a magnetic north pole N of the first permanent magnet 30 is directed towards the center element 11, a magnetic north pole N of the second permanent magnet 40 may be also directed towards the center element 11, and consequently, the magnetic south pole S of the second permanent magnet 40 may be directed towards the housing element 10. However, it is understood, that the magnetic orientation of the first permanent magnet 30 and the second permanent magnet 40 may be also orientated in an opposite direction such that the magnetic south pole S of the first permanent magnet 30 and the second permanent magnet 40 both are directed towards to the center element 11.

In particular, a diameter of the second permanent magnet 40 may be larger than a diameter of the center element 11.

By arranging the second permanent magnet 40 between the center element 11 and the housing element 10, a magnetic flow, in particular a magnetic short circuit between the center element and the housing element 10 may be interrupted and the center element may be magnetically isolated. In this way, the magnetic field may be further forced towards the gap 12 between the center element 11 and the tip 13.

Figure 4:
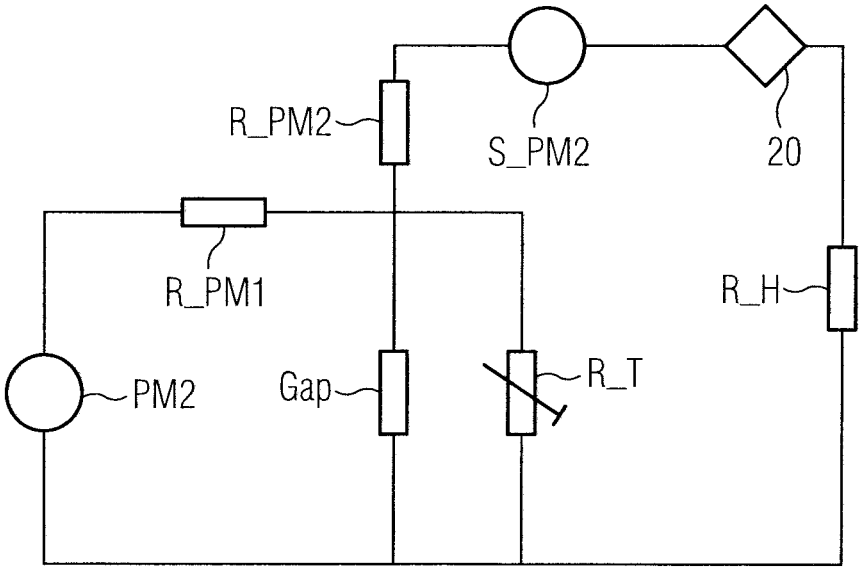
FIG. 4: shows a schematic equivalent circuit diagram of a magnetic structure according to an embodiment.

FIG. 4 shows an illustration of a schematic equivalent circuit diagram of the magnetic structure 1 according to an embodiment. The schematic equivalent circuit diagram may correspond, for example, to an arrangement according to the above described embodiments. As can be seen in this circuit diagram, a magnetic path comprising the first permanent magnet 30 (PM1) and the related reluctance R_PM1 is arranged in parallel to a magnetic path comprising the solenoid 20 and the reluctance R_H of the housing element 10. Further, this path may also comprise the second permanent magnet 40 (S_PM2) and the related reluctance R_PM2. The gap 12 between the center element 11 and the tip 13 is represented by the element Gap.

In the above described examples according to FIGS. 1 to 3, the first permanent magnet 30 may be slightly moved in a direction parallel to the symmetry axis B-B. By adapting the position of the first permanent magnet 30 the magnetic flow through the gap 12 may be adapted accordingly. This adjustment of the magnetic flow by adapting the position of the first permanent magnet 30 is represented by the adjustable element R_T in the schematic equivalent circuit diagram of FIG. 4.

Figure 5:
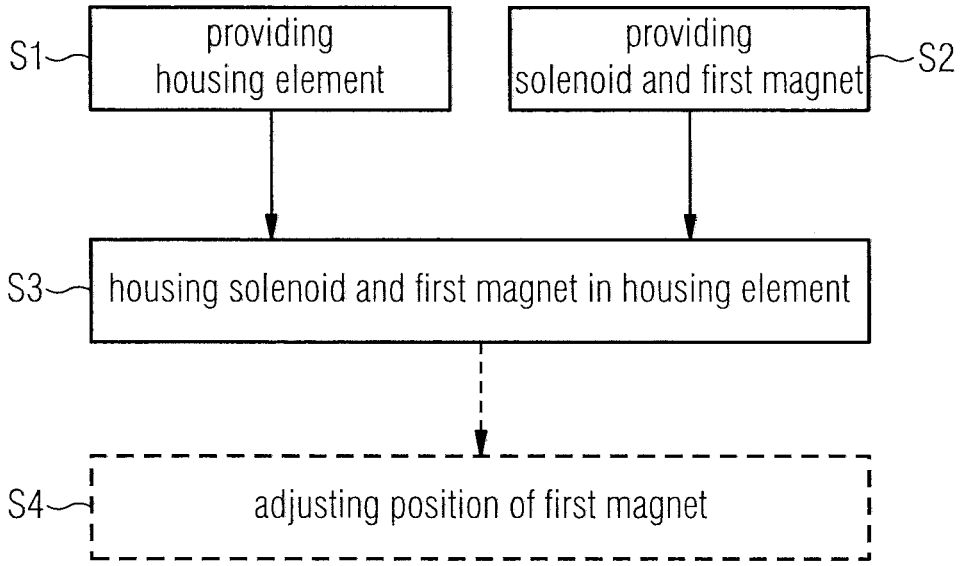
FIG. 5: shows a flow diagram of a method for manufacturing a magnetic structure according to an embodiment.

FIG. 5 shows a flow diagram illustrating a method for manufacturing a magnetic structure 1 for an electromagnetic resonator. The method may comprise any kind of step which may be necessary for manufacturing a magnetic structure 1 as already described in detail above. Further, the above described magnetic structure and the resulting electromagnetic resonator may comprise any kind of element according to the method as described below.

In a step S1, a housing element 10 with a high magnetic permeability is provided. Further, in step S2, a solenoid 20 and a first permanent magnet 30 are provided.

In step S3, the solenoid and the first permanent magnet are arranged together in the housing element 10. In particular, the solenoid 20 and the first permanent magnet 30 are arranged concentrically to each other with respect to a common predetermined axis. The solenoid 20 and the first permanent magnet 30 are combined such that the magnetic field lines of the first permanent magnet 30 are essentially perpendicular to the magnetic field lines of the magnetic field generated by the solenoid 20. In particular, the magnetic field lines are at least essentially perpendicular in an inner area of the concentrically arranged solenoid and the first permanent magnet.

Optionally, in a step S4, the position of the first permanent magnet 30 may be adjusted in a direction parallel to a symmetry axis of the solenoid and/or the first permanent magnet 30.

The above described magnetic structures 1 may be used for electromagnetic resonators, in particular for electromagnetic resonators such as a YIG resonator. Such resonators may be used, for example in filter devices for precisely filtering high frequency signals. Further, such resonators may be used in oscillators. For example, an oscillator with such a magnetic structure and a respective resonator may be used as a signal source for a precise high frequency signal having low phase noise. For example, such filter devices or oscillators may be used for measurement devices such as spectrum analyzers or the like. Further, such devices may be used for any kind of signal generators, in particular for signal generators generating local frequencies with high precision, for example in a test scenario for testing radio frequency devices.

Summarizing, the present invention relates to a magnetic structure, in particular a magnetic structure which can be used for an electromagnetic resonator. The magnetic structure comprises at least a solenoid and a permanent magnet, wherein the solenoid and the permanent magnet are concentrically arranged to each other such that the magnetic field lines provided by the permanent magnet are at least essentially perpendicular to magnetic field lines of a magnetic field generated by the solenoid. The arrangement of the permanent magnet and the solenoid may be housed by an element with a high magnetic permeability. In particular, the permanent magnet may be a permanent magnet with radial oriented magnetic field.

In the foregoing detailed description, various features are grouped together in one or more examples or examples for the purpose of streamlining the disclosure. It is understood that the above description is intended to be illustrative, and not restrictive. It is intended to cover all alternatives, modifications and equivalents as may be included within the scope of the invention. Many other examples will be apparent to one skilled in the art upon reviewing the above specification.

Specific nomenclature used in the foregoing specification is used to provide a thorough understanding of the invention. However, it will be apparent to one skilled in the art in light of the specification provided herein that the specific details are not required in order to practice the invention. Thus, the foregoing descriptions of specific embodiments of the present invention are presented for purposes of illustration and description. They are not intended to be exhaustive or to limit the invention to the precise forms disclosed; obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. Throughout the specification, the terms "including" and "in which" are used as the plain-English equivalents of the respective terms "comprising" and "wherein," respectively. Moreover, the terms "first," "second," and "third," etc., are used merely as labels, and are not intended to impose numerical requirements on or to establish a certain ranking of importance of their objects.

LIST OF REFERENCE SIGNS

1 magnetic structure
10 housing element
11 center element
12 gap
13 tip
15 YIG sphere
20 solenoid
30 first permanent magnet

40 second permanent magnet
50 free space
60 circuit device
N,S magnetic poles
S1 . . . S4 method steps

The invention claimed is:

1. A magnetic structure for an electromagnetic resonator, the magnetic structure comprising:

a housing element having a high magnetic permeability;

a solenoid; and a first permanent magnet;

wherein the solenoid and the first permanent magnet are housed in the housing element and the solenoid and the first permanent magnet are arranged concentrically to each other with respect to a predetermined axis; and wherein magnetic field lines of the first permanent magnet are essentially perpendicular to magnetic field lines of a magnetic field generated by the solenoid at least in an inner area of the concentrically arranged solenoid and first permanent magnet.

2. The magnetic structure of claim 1, wherein at least the solenoid and the first permanent magnet have a rotationally symmetric shape.

3. The magnetic structure of claim 1, wherein the magnetic structure has a rotationally symmetric shape.

4. The magnetic structure of claim 1, wherein the magnetic structure comprises a free space in an inner area of the housing element accommodating the solenoid and the first permanent magnet.

5. The magnetic structure of claim 4, comprising an oscillator circuit or a filter circuit, wherein the oscillator circuit or filter circuit is arranged in the free space of the magnetic structure.

6. The magnetic structure of claim 1, comprising a center element having a high magnetic permeability, wherein the center element is arranged in the inner area of the concentrically arranged solenoid and first permanent magnet.

7. The magnetic structure of claim 6, comprising a gap between the center element and the housing element.

8. The magnetic structure of claim 7, comprising an yttrium iron garnet sphere disposed in the gap.

9. The magnetic structure of claim 7, comprising a second permanent magnet arranged between the center element and the housing element.

10. The magnetic structure of claim 9, wherein the gap is located at a side of the center element opposite the side facing towards the second permanent magnet.

11. The magnetic structure of claim 9, wherein a diameter of the second permanent magnet is larger than a diameter of the center element.

12. The magnetic structure of claim 1, wherein a position of the first permanent magnet is adjustable in a direction parallel to a symmetry axis of the solenoid.

13. The magnetic structure of claim 1, wherein the first permanent has a shape of a toroid.

14. The magnetic structure of claim 1, wherein the first permanent magnet comprises multiple segment magnets.

15. The magnetic structure of claim 1, wherein the first permanent magnet provides a magnetic field having radial oriented field lines.

16. The magnetic structure of claim 1, wherein the housing element comprises a ferromagnetic material, in particular iron, nickel, cobalt or an alloy thereof.

17. An electromagnetic resonator comprising the magnetic structure of claim 1.

18. An oscillator comprising the magnetic structure of claim 1.

19. A method for manufacturing a magnetic structure for an electromagnetic resonator, the method comprising:

providing a housing element having a high magnetic permeability;

providing a solenoid and a first permanent magnet;

arranging the solenoid and a first permanent magnet in the housing element, wherein the solenoid and the first permanent magnet are arranged concentrically to each other with respect to a predetermined axis; and wherein magnetic field lines of the first permanent magnet are essentially perpendicular to magnetic field lines of a magnetic field generated by the solenoid at least in an inner area of the concentrically arranged solenoid and first permanent magnet.

20. The method of claim 19, comprising adjusting a position of the first permanent magnet in a direction parallel to a symmetry axis of the solenoid.

* * * * *